US009963311B1

(12) United States Patent
Chou et al.

(10) Patent No.: US 9,963,311 B1
(45) Date of Patent: May 8, 2018

(54) PAPER SEPARATION MECHANISM

(71) Applicant: Foxlink Image Technology Co., Ltd., New Taipei (TW)

(72) Inventors: Tsung Ching Chou, New Taipei (TW); Chi Chung Chang, New Taipei (TW)

(73) Assignee: FOXLINK IMAGE TECHNOLOGY CO., LTD., New Taipei (TW)

( * ) Notice: Subject to any disclaimer, the term of this patent is extended or adjusted under 35 U.S.C. 154(b) by 0 days. days.

(21) Appl. No.: 15/674,079

(22) Filed: Aug. 10, 2017

(51) Int. Cl.
*B65H 3/06* (2006.01)

(52) U.S. Cl.
CPC ..... *B65H 3/0669* (2013.01); *B65H 3/0684* (2013.01); *B65H 2403/72* (2013.01)

(58) Field of Classification Search
CPC ..... B65H 3/0684; B65H 3/0669
See application file for complete search history.

(56) References Cited

U.S. PATENT DOCUMENTS 3,981,497 A * 9/1976 Feinstein, Jr. ..... B65H 1/18 271/10.11
2005/0029732 A1* 2/2005 Chang ..... B65H 3/0615 271/113
2015/0084264 A1* 3/2015 Hino ..... B65H 85/00 271/3.18
2015/0321862 A1* 11/2015 Song ..... B65H 3/0669 271/117
2015/0329302 A1* 11/2015 Hayashi ..... B65H 1/04 271/117
2016/0177989 A1* 6/2016 Alagos ..... F16B 7/042 271/117
2016/0185143 A1* 6/2016 Aoki ..... B65H 3/0684 271/117

* cited by examiner

*Primary Examiner* — David H Bollinger
(74) *Attorney, Agent, or Firm* — WPAT, PC

(57) ABSTRACT

A paper separation mechanism includes a separation roller assembly, a one-way clutch module, a transmission gear assembly connected with and driving the one-way clutch module, a driving motor for driving the transmission gear assembly, and a locking module. The separation roller assembly includes a separation shaft, a separation roller fastened around the separation shaft, and a pickup roller disposed to the separation roller. The one-way clutch module includes a gear shaft, and a one-way clutch mounted around the gear shaft. The locking module includes a swing arm, a hooking portion fastened to a bottom of the swing arm, a blocking portion fastened under the swing arm, and a spring disposed to the bottom of the swing arm. One side of the swing arm is fastened to the gear shaft, the other side of the swing arm is fastened to the separation shaft.

5 Claims, 4 Drawing Sheets

PAPER SEPARATION MECHANISM

BACKGROUND OF THE INVENTION

1. Field of the Invention

The present invention generally relates to a paper separation mechanism, and more particularly to a paper separation mechanism capable of switching from a paper non-separation function to a paper separation function.

2. The Related Art

Nowadays, with the improvement of softwares and hardwares, a conventional scanner has become one of basic equipments of many computer users. The conventional scanner is capable of scanning and inputting character and image materials into a computer, and processing the character and image materials. The character and image materials include documents, magazines, books and pictures. In order to support special kinds of paper which is report paper, multiple sheets of carbon paper, triplet type invoice paper, etc. The conventional scanner generally includes an automatic paper feeding device.

Referring to FIG. 4, a conventional paper separation mechanism 100' is assembled in the automatic paper feeding device. The conventional paper separation mechanism 100' mainly switches from a paper non-separation function to a paper separation function by virtue of a manual operation structure mode. The conventional paper separation mechanism 100' includes a pickup roller assembly 10', a separation roller assembly 20', a transmission roller assembly 30', and a driving lever 40' capable of controlling the separation roller assembly 20' to be engaged with or break away from the transmission roller assembly 30'. The pickup roller assembly 10' includes a pickup roller 11' and a pickup shaft 12'. The separation roller assembly 20' includes a separation shaft 21', a separation gear 22' coaxially connected with the separation shaft 21', and a separation roller 23' fastened to the separation shaft 21'. A torque limiter 50' is fastened to and connected with one side of the separation roller 23'. The transmission roller assembly 30' includes a fastening gear 31' incapable of rotating. In use, when the fastening gear 31' is engaged with the separation gear 22' by virtue of the driving lever 40', the separation shaft 21' has no way of rotating, at the moment, the torque limiter 50' provides a paper separation force, so that the conventional paper separation mechanism 100' has a paper separation function. When the fastening gear 31' breaks away from the separation gear 22' by virtue of the driving lever 40', the separation shaft 21' rotates, at the moment, the torque limiter 50' rotates together with the separation shaft 21', the separation roller 23' rotates and cooperates with the pickup roller 11' to pick up and further feed the special kinds of the paper, so that the special kinds of the paper are capable of being scanned.

However, the conventional paper separation mechanism 100' has more components, and a structure of the conventional paper separation mechanism 100' needs extra space to be designed, so the conventional paper separation mechanism 100' has a complex structure and an occupying space of the conventional paper separation mechanism 100' is increased. Moreover, the conventional paper separation mechanism 100' has no way of switching from the paper non-separation function to the paper separation function by virtue of softwares that makes the conventional paper separation mechanism 100' have a higher cost.

SUMMARY OF THE INVENTION

An object of the present invention is to provide a paper separation mechanism having a simple structure and a lower cost, and capable of switching from a paper non-separation function to a paper separation function. The paper separation mechanism includes a separation roller assembly, a one-way clutch module, a transmission gear assembly connected with and driving the one-way clutch module, a driving motor for driving the transmission gear assembly, and a locking module. The separation roller assembly includes a separation shaft, a separation roller fastened around the separation shaft, and a pickup roller disposed to the separation roller. The pickup roller is capable of being disposed on and contacting with the separation roller, and the pickup roller is capable of being separated from and being located above the separation roller. The one-way clutch module includes a gear shaft, and a one-way clutch mounted around the gear shaft. The one-way clutch is capable of rotating in a one-way direction, when the one-way clutch rotates, the separation shaft is capable of being driven by the one-way clutch module to swing downward to make the separation roller break away from the pickup roller. The locking module includes a swing arm, a hooking portion, a blocking portion and a spring. One side of the swing arm is fastened to the gear shaft, the other side of the swing arm is fastened to the separation shaft. The hooking portion is fastened to a bottom of the swing arm and is located under the separation roller. The blocking portion is fastened under the swing arm and is corresponding to the hooking portion. The spring is disposed to the bottom of the swing arm and being capable of elastically pushing against the swing arm. The driving motor rotates clockwise to drive the transmission gear assembly to rotate clockwise so as to drive the gear shaft to rotate clockwise. The gear shaft brings along the swing arm together with the hooking portion, the separation shaft and the separation roller to swing downward towards the blocking portion until the hooking portion hooks the blocking portion, at the moment, the spring is compressed, the separation roller breaks way from the pickup roller, so a paper non-separation function is realized. The driving motor rotates anticlockwise to drive the transmission gear assembly to rotate anticlockwise, the one-way clutch idles so that the swing arm and the hooking portion have no way of being brought along to swing upward, and the hooking portion and the blocking portion keep a hooking status, at the moment, the spring is compressed, the separation roller continues breaking way from the pickup roller, the transmission gear assembly drives the pickup roller to rotate clockwise to pick up paper. The driving motor rotates clockwise again to drive the transmission gear assembly to rotate clockwise so as to drive the gear shaft to rotate clockwise, the gear shaft brings along the swing arm together with the hooking portion to further swing downward to make the hooking portion break way from the blocking portion, at the moment, the spring is released to restore to an original status so as to elastically push against the swing arm together with the hooking portion, the separation shaft and the separation roller to swing upward and approaching to the pickup roller, the separation roller returns to an original position, the pickup roller rotates anticlockwise, the separation roller contacts with the pickup roller to realize a paper separation function.

As described above, the paper separation mechanism has less components, and a structure of the paper separation mechanism is without needing extra space to be designed, so the paper separation mechanism has a simple structure and an occupying space of the paper separation mechanism is reduced. Moreover, the hooking portion is capable of hooking or breaking way from the blocking portion, so that the separation roller is capable of breaking way from or contacting with the pickup roller to make the paper separation mechanism have the paper non-separation function or the paper separation function, in that case, the paper separation mechanism is capable of automatically switching from paper non-separation function to the paper separation function by virtue of softwares, so that the paper separation mechanism has a lower cost.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
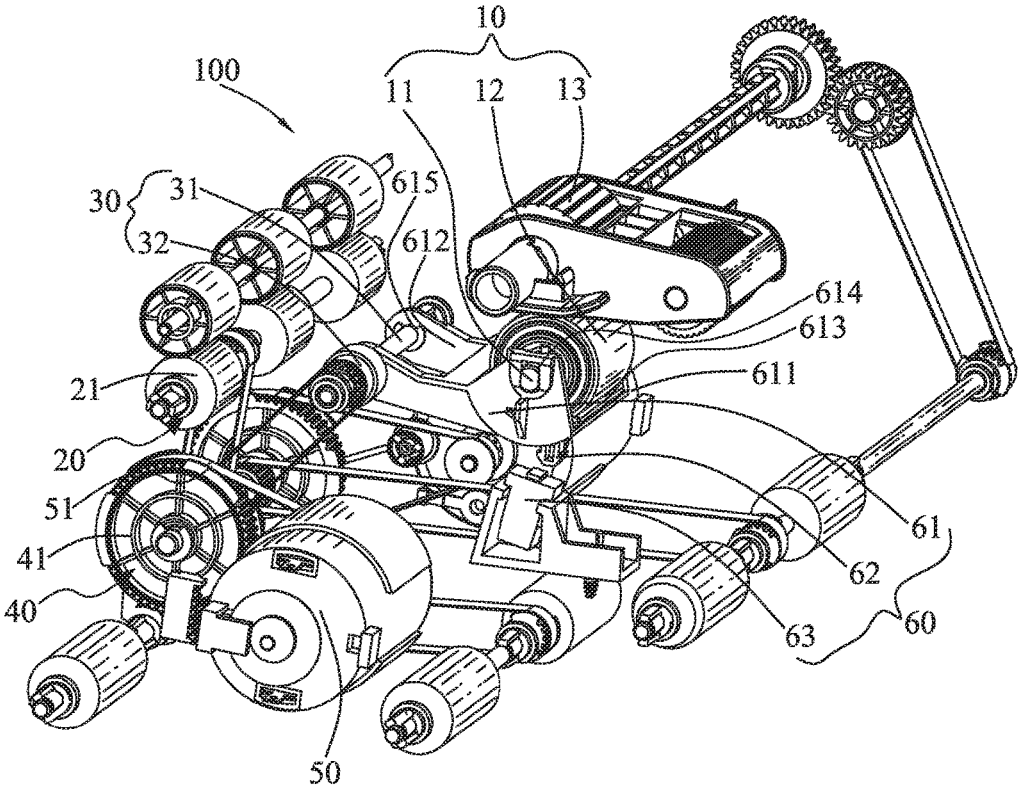
FIG. 1 is a perspective view of a paper separation mechanism in accordance with a preferred embodiment of the present invention, wherein a spring of the paper separation mechanism is omitted.
Figure 2:
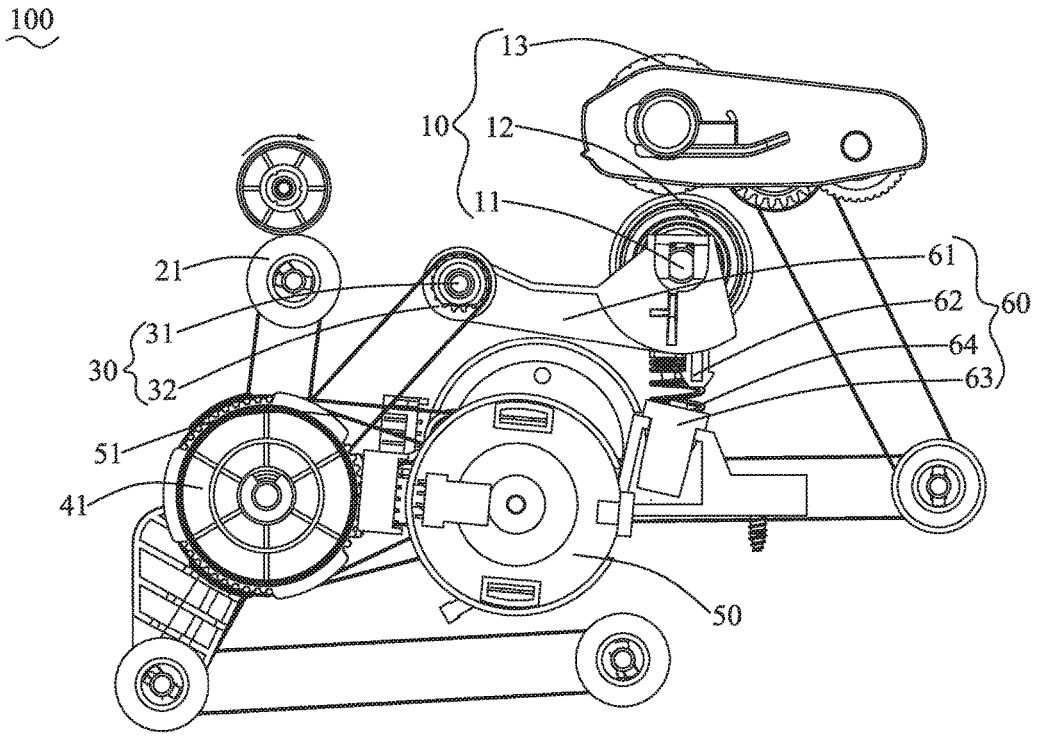
FIG. 2 is a lateral diagrammatic drawing showing a status of the paper separation mechanism in accordance with the preferred embodiment of the present invention, wherein the paper separation mechanism has a paper separation function.
Figure 3:
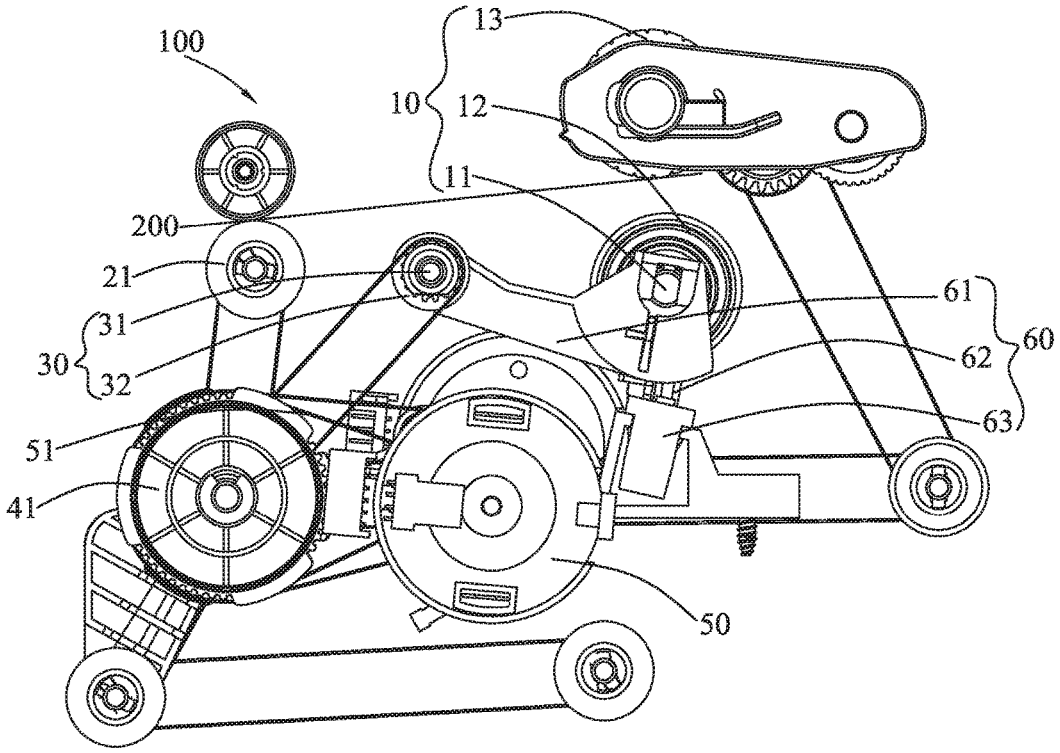
FIG. 3 is a lateral view showing another status of the paper separation mechanism in accordance with the preferred embodiment of the present invention, wherein the paper separation mechanism has a paper non-separation function and the spring of the paper separation mechanism is omitted.
Figure 4:
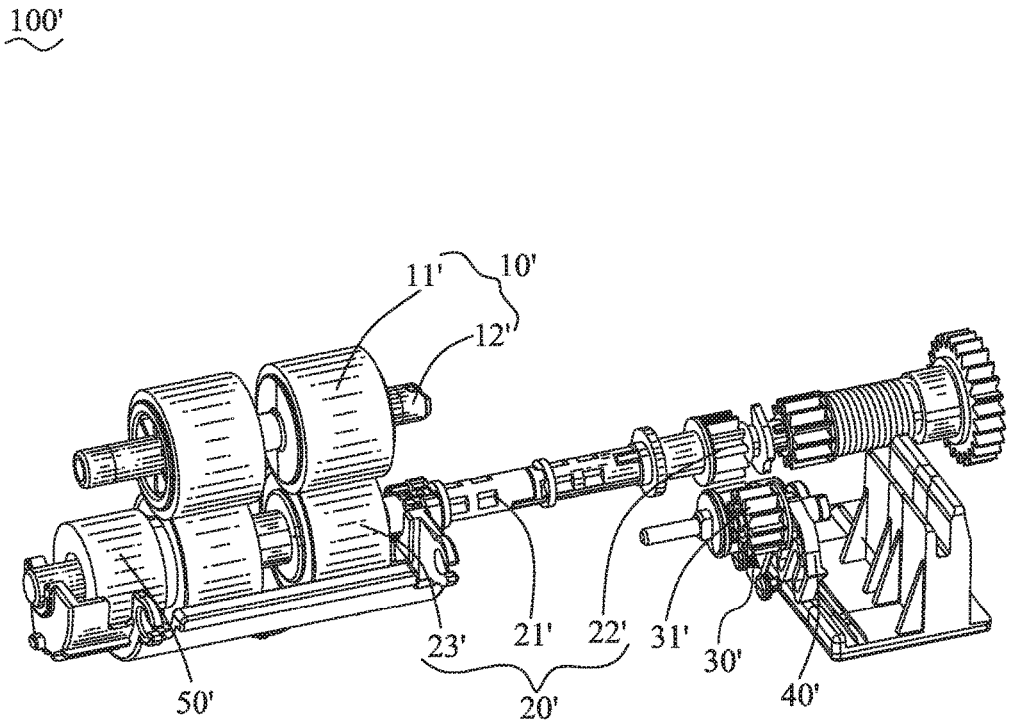
FIG. 4 (Prior Art)
FIG. 4 is a perspective view of a conventional paper separation mechanism in prior art.

With reference to FIG. 1 to FIG. 3, a paper separation mechanism 100 in accordance with a preferred embodiment of the present invention is shown. The paper separation mechanism 100 is assembled in an automatic paper feeding device (not shown). The paper separation mechanism 100 is applicable for separating paper 200 which includes different kinds of the paper 200. The paper separation mechanism 100 includes a separation roller assembly 10, a feeding roller assembly 20, a one-way clutch module 30, a transmission gear assembly 40, a driving motor 50 and a locking module 60. In this preferred embodiment, a clockwise direction is defined as a forward direction, so a clockwise rotation shown in FIG. 2 is defined as a forward rotation. A direction from the separation roller assembly 10 to the feeding roller assembly 20 is defined as a direction from a rear end of the paper separation mechanism 100 to a front end of the paper separation mechanism 100. When the paper separation mechanism 100 is in work, the paper 200 is fed into the paper separation mechanism 100 from the rear end of the paper separation mechanism 100.

Referring to FIG. 1 to FIG. 3, the separation roller assembly 10 includes a separation shaft 11, a separation roller 12 fastened around the separation shaft 11, and a pickup roller 13 disposed to the separation roller 12. The pickup roller 13 is capable of being disposed on and contacting with the separation roller 12, and the pickup roller 13 is capable of being separated from and being located above the separation roller 12.

The feeding roller assembly 20 includes a feeding roller 21.

The one-way clutch module 30 includes a gear shaft 31, and a one-way clutch 32 mounted around the gear shaft 31. The one-way clutch 32 is capable of rotating in a one-way direction. When the one-way clutch 32 rotates, the separation shaft 11 is capable of being driven by the one-way clutch module 30 to swing downward to make the separation roller 12 break away from the pickup roller 13.

Referring to FIG. 1 to FIG. 3, the transmission gear assembly 40 is connected with and drives the one-way clutch module 30. Specifically, the transmission gear assembly 40 includes a transmission gear 41 connected with the driving motor 50 by virtue of a belt 51 being looped around the transmission gear 41 and the driving motor 50. The driving motor 50 is used for driving the transmission gear assembly 40. The driving motor 50 drives the transmission gear 41. The transmission gear 41 of the transmission gear assembly 40 is connected with and drives the gear shaft 31 of the one-way clutch module 30. The transmission gear 41 is connected with and drives the feeding roller 21. The transmission gear 41 drives the pickup roller 13.

The locking module 60 includes a swing arm 61, a hooking portion 62, a blocking portion 63 and a spring 64. One side of the swing arm 61 is fastened to the gear shaft 31. The other side of the swing arm 61 is fastened to the separation shaft 11. The hooking portion 62 is fastened to a bottom of the swing arm 61 and is located under the separation roller 12. The blocking portion 63 is fastened under the swing arm 61 and is corresponding to the hooking portion 62. The spring 64 is disposed to the bottom of the swing arm 61 and is capable of elastically pushing against the swing arm 61.

Specifically, the swing arm 61 has a base portion 611, and two fastening arms 612 connected with one side of the base portion 611 towards the gear shaft 31. The base portion 611 of the swing arm 61 opens a receiving space 613 vertically penetrating through a middle of a top surface of the base portion 611 facing to the pickup roller 13. Two opposite end walls of the receiving space 613 transversely open two first fastening holes 614. The two fastening arms 612 open two second fastening holes 615, respectively. The one side of the swing arm 61 is fastened to the gear shaft 31 by virtue of the gear shaft 31 passing through the two second fastening holes 615 of the two fastening arms 612. The other side of the swing arm 61 is fastened to the separation shaft 11 by virtue of two opposite ends of the separation shaft 11 passing through the two first fastening holes 614. The separation roller 12 is received in the receiving space 613.

Referring to FIG. 1 to FIG. 3, when the paper separation mechanism 100 is without working, the separation roller 12 contacts with the pickup roller 13.

When the paper separation mechanism 100 is in work, at first, the driving motor 50 rotates clockwise to drive the transmission gear assembly 40 to rotate clockwise, the transmission gear assembly 40 drives the one-way clutch 32 to rotate clockwise so as to drive the gear shaft 31 to rotate clockwise, the gear shaft 31 brings along the swing arm 61 together with the hooking portion 62, the separation shaft 11 and the separation roller 12 to swing downward towards the blocking portion 63 until the hooking portion 62 hooks the blocking portion 63, at the moment, the spring 64 is compressed, the separation roller 12 breaks way from the pickup roller 13, so a paper non-separation function is realized, correspondingly, the paper separation mechanism 100 has the paper non-separation function.

Then, the driving motor 50 rotates anticlockwise to drive the transmission gear 41 of the transmission gear assembly 40 to rotate anticlockwise, the one-way clutch 32 idles so that the swing arm 61 and the hooking portion 62 have no way of being brought along to swing upward, and the hooking portion 62 and the blocking portion 63 keep a hooking status, at the moment, the spring 64 is compressed, the separation roller 12 continues breaking way from the pickup roller 13, the transmission gear 41 of the transmission gear assembly 40 drives the pickup roller 13 to rotate clockwise to pick up the paper 200 and drives the feeding roller 21 to further feed the paper 200.

At last, the driving motor 50 rotates clockwise again to drive the transmission gear 41 of the transmission gear assembly 40 to rotate clockwise, the transmission gear assembly 40 drives the one-way clutch 32 to rotate clockwise so as to drive the gear shaft 31 to rotate clockwise, the gear shaft 31 brings along the swing arm 61 together with the hooking portion 62 to further swing downward to make the hooking portion 62 break way from the blocking portion 63, and the swing arm 61 brings along the separation shaft 11 together with the separation roller 12 to further swing downward, at the moment, the spring 64 is released to restore to an original status so as to elastically push against the swing arm 61 together with the hooking portion 62, the separation shaft 11 and the separation roller 12 to swing upward and approaching to the pickup roller 13, the separation roller 12 returns to an original position, the pickup roller 13 rotates anticlockwise, the separation roller 12 contacts with the pickup roller 13 to realize a paper separation function, so the paper separation mechanism 100 has the paper separation function.

So, the hooking portion 62 is capable of hooking or breaking way from the blocking portion 63, so that the separation roller 12 is capable of breaking way from or contacting with the pickup roller 13 to make the paper separation mechanism 100 have the paper non-separation function or the paper separation function, in that case, the paper separation mechanism 100 is capable of automatically switching from the paper non-separation function to the paper separation function by virtue of softwares.

As described above, the paper separation mechanism 100 has less components, and a structure of the paper separation mechanism 100 is without needing extra space to be designed, so the paper separation mechanism 100 has a simple structure and an occupying space of the paper separation mechanism 100 is reduced. Moreover, the hooking portion 62 is capable of hooking or breaking way from the blocking portion 63, so that the separation roller 12 is capable of breaking way from or contacting with the pickup roller 13 to make the paper separation mechanism 100 have the paper non-separation function or the paper separation function, in that case, the paper separation mechanism 100 is capable of automatically switching from paper non-separation function to the paper separation function by virtue of the softwares, so that the paper separation mechanism 100 has a lower cost.

What is claimed is:

1. A paper separation mechanism, comprising:

a separation roller assembly including a separation shaft, a separation roller fastened around the separation shaft, and a pickup roller, wherein the pickup roller is disposed on and contacting with the separation roller at an original position;

a feeding roller assembly, including a feeding roller;

a one-way clutch module including a gear shaft, and a one-way clutch mounted around the gear shaft, wherein the one-way clutch rotates in a one-way direction;

a transmission gear assembly connected with and driving the one-way clutch module;

a driving motor for driving the transmission gear assembly; and a locking module including a swing arm, a hooking portion, a blocking portion, and a spring, wherein the swing arm connects the gear shaft to the separation shaft, the hooking portion is fastened to a bottom of the swing arm and located under the separation roller, the blocking portion is fastened under the swing arm and corresponding to the hooking portion, the spring is disposed to the bottom of the swing arm and elastically pushing against the swing arm;

wherein, a paper non-separation function is performed when the driving motor rotates clockwise, the driving motor drives the transmission gear assembly to rotate clockwise so as to drive the gear shaft to rotate clockwise, the gear shaft brings along the swing arm together with the hooking portion, the separation shaft, and the separation roller to swing downward towards the blocking portion until the hooking portion hooks the blocking portion, the spring is compressed, and the separation roller breaks way from the pickup roller;

wherein, a paper feeding function is performed when the driving motor rotates anticlockwise, the driving motor drives the transmission gear assembly to rotate anticlockwise, the one-way clutch idles so that the swing arm and the hooking portion have no way of being brought along to swing upward, the hooking portion and the blocking portion keep a hooking status while the spring is still compressed, the separation roller continues breaking way from the pickup roller, and the transmission gear assembly drives the pickup roller to rotate clockwise to pick up paper;

wherein, a paper separation function is performed when the driving motor rotates clockwise again to drive the transmission gear assembly to rotate clockwise so as to drive the gear shaft to rotate clockwise, the gear shaft brings along the swing arm together with the hooking portion to further swing downward to make the hooking portion break way from the blocking portion for releasing the spring to elastically push against the swing arm together with the hooking portion, the separation shaft, and the separation roller to swing upward and approaching to the pickup roller, the separation roller returns to the original position, the pickup roller rotates anticlockwise, and the separation roller contacts with the pickup roller.

2. The paper separation mechanism as claimed in claim 1, wherein the transmission gear assembly includes a transmission gear connected with the driving motor by a first belt looped around the transmission gear and the driving motor, the transmission gear is connected with and drives the gear shaft, the feeding roller, and the pickup roller.

3. The paper separation mechanism as claimed in claim 2, wherein the transmission gear is connecting to the pickup roller via a second belt, a third belt, and pickup roller driving gears.

4. The paper separation mechanism as claimed in claim 1, wherein the swing arm has a base portion, the base portion opens a receiving space vertically penetrating through a middle of a top surface of the base portion facing to the pickup roller, and the separation roller is received in the receiving space.

5. The paper separation mechanism as claimed in claim 4, wherein the swing arm has two fastening arms connected with one side of the base portion towards the gear shaft, two opposite end walls of the receiving space transversely open two first fastening holes, the two fastening arms open two second fastening holes respectively, the one side of the swing arm is fastened to the gear shaft by virtue of the gear shaft passing through the two second fastening holes, and the other side of the swing arm is fastened to the separation shaft by virtue of two opposite ends of the separation shaft passing through the two first fastening holes.

* * * * *